United States Patent [19]

Rulison

[11] Patent Number: 4,749,324

[45] Date of Patent: Jun. 7, 1988

[54] APPARATUS FOR LIFTING AND POSITIONING CONSTRUCTION MATERIAL

[76] Inventor: Arthur Rulison, P.O. Box 36, Ridge Crest, N.C. 28770

[21] Appl. No.: 31,907

[22] Filed: Mar. 30, 1987

[51] Int. Cl.[4] ..... B66C 23/04

[52] U.S. Cl. ..... 414/10; 212/261; 212/265; 414/680; 414/734

[58] Field of Search ..... 414/10, 11, 12, 680, 414/734; 212/160, 254, 259, 261, 264, 265; 280/638, 656, 659

[56] References Cited

U.S. PATENT DOCUMENTS

| | | | |
|---|---|---|---|
| 2,389,872 | 11/1945 | Ruger et al. | 212/261 X |
| 2,846,188 | 8/1958 | Pierce | 212/254 X |
| 3,298,154 | 1/1967 | Behr et al. | 414/10 X |
| 3,667,632 | 6/1972 | Tidswell | 414/680 |
| 3,757,484 | 9/1973 | Williamson et al. | 414/10 X |

FOREIGN PATENT DOCUMENTS

| | | | |
|---|---|---|---|
| 2322261 | 11/1974 | Fed. Rep. of Germany | 212/259 |
| 2917839 | 11/1980 | Fed. Rep. of Germany | 414/680 |
| 1254746 | 1/1961 | France | 212/259 |
| 2383117 | 11/1978 | France | 414/12 |
| 2105679 | 3/1983 | United Kingdom | 212/261 |

OTHER PUBLICATIONS

Air Technical Industries Brochure 6464–B; Air Technical Ind., 7501 Clover Ave., Mentor, Ohio, 44060; copyright 1979.

*Primary Examiner*—Leslie J. Paperner
*Attorney, Agent, or Firm*—David M. Carter

[57] ABSTRACT

There is provided an apparatus for lifting and positioning construction material such as building logs. The apparatus includes a frame having a pair of interconnected parallel beams. A pair of large fixed axis wheels are attached to one end of the frame while a pair of smaller swivelable wheels are connected to the other end of the frame. A winch is connected to a beam which extents over the frame at various elevations. A grasping mechanism is attached to the winch for holding the construction material.

19 Claims, 2 Drawing Sheets

APPARATUS FOR LIFTING AND POSITIONING CONSTRUCTION MATERIAL

BACKGROUND OF THE INVENTION

This invention relates to apparatus for lifting and positioning construction material. More particularly, it relates to apparatus for lifting and positioning logs in the construction of log houses.

The construction of log houses is a very labor intensive business. It requires several very strong workers to lift and position the logs which form the walls of the house. Not only is this type of construction very expensive because of the high labor cost but also is prone to injuries resulting in human suffering and further increased cost to the builder.

There have recent attempts to somewhat mechanize the lifting and positioning of logs. One such attempt is to utilize a standard floor lift which normally is used to lift motors out of automobiles. The standard floor lift includes a frame having four small wheels all of which are adapted to swivel 360 degrees. Because all four wheels swivel, the log home builder has found it very difficult to maneuver this devise. Furthermore if the floor lift is used on soft ground it tends to sink in because the wheels are so small thus further restricting maneuverability.

The floor lift further includes an arm which extends over one end with a chain having a hook extending from the arm. The arm may be moved upwardly or downwardly by the use of an air cylinder. Because the chain is of a fixed length it is often necessary for workers to actually lift the log in order to attach the log to the end of the chain. Therefore the use of an automotive type floor lift to lift and position logs remains labor intensive and is very cumbersome.

OBJECTS OF THE INVENTION

It is therefore one object of this invention to provide an improved apparatus for lifting and positioning construction material.

It is another object to provide an improved apparatus for lifting and positioning logs in connection with the construction of log houses.

It is still another object to provide an apparatus for lifting and positioning construction material which is easy to use and efficient to operate.

SUMMARY OF THE INVENTION

In accordance with one form of this invention there is provided an apparatus for lifting and positioning construction materials. The apparatus includes a frame having a pair of somewhat parallel beams. First and second wheels are connected to the parallel beams at one end of the frame. At least a third wheel is connected to the other end of the frame. A third beam connects the pair of somewhat parallel beams together. A fourth beam extends upwardly from the frame. A fifth beam is swivelly connected to the fourth beam and projects over the first and second wheels. A winch is connected to the fifth beam. The winch includes a rope which is connected to a grasping mechanism for holding the construction material.

In accordance with another form of this invention there is provided an apparatus for lifting and positioning construction materials. The apparatus includes a frame having a pair of somewhat parallel beams. First and second wheels are connected to the parallel beams at one end of the frame. The first and second wheels are each mounted on a non-swivelling axis so that the first and second wheels will generally roll in a straight line only. At least a third wheel is connected to the other end of the frame. The third wheel and any other wheels which are connected to the other end of the frame are adapted to swivel, preferably 360 degrees. A third beam connects the pair of somewhat parallel beams together. A fourth beam extends upwardly from the frame. A fifth beam is swivelly connected to the fourth beam. The fifth beam projects over the first and second wheels. A mechanism is connected to the fifth beam for grasping construction materials.

BRIEF DESCRIPTION OF THE DRAWINGS

The subject matter which is regarded as the invention as set forth in the appended claims. The invention itself, however together with further objects and advantages thereof can be better understood by reference to the following description taken in conjunction with the accompanying drawings in which:

DESCRIPTION OF THE PREFERRED EMBODIMENT

Figure 1:
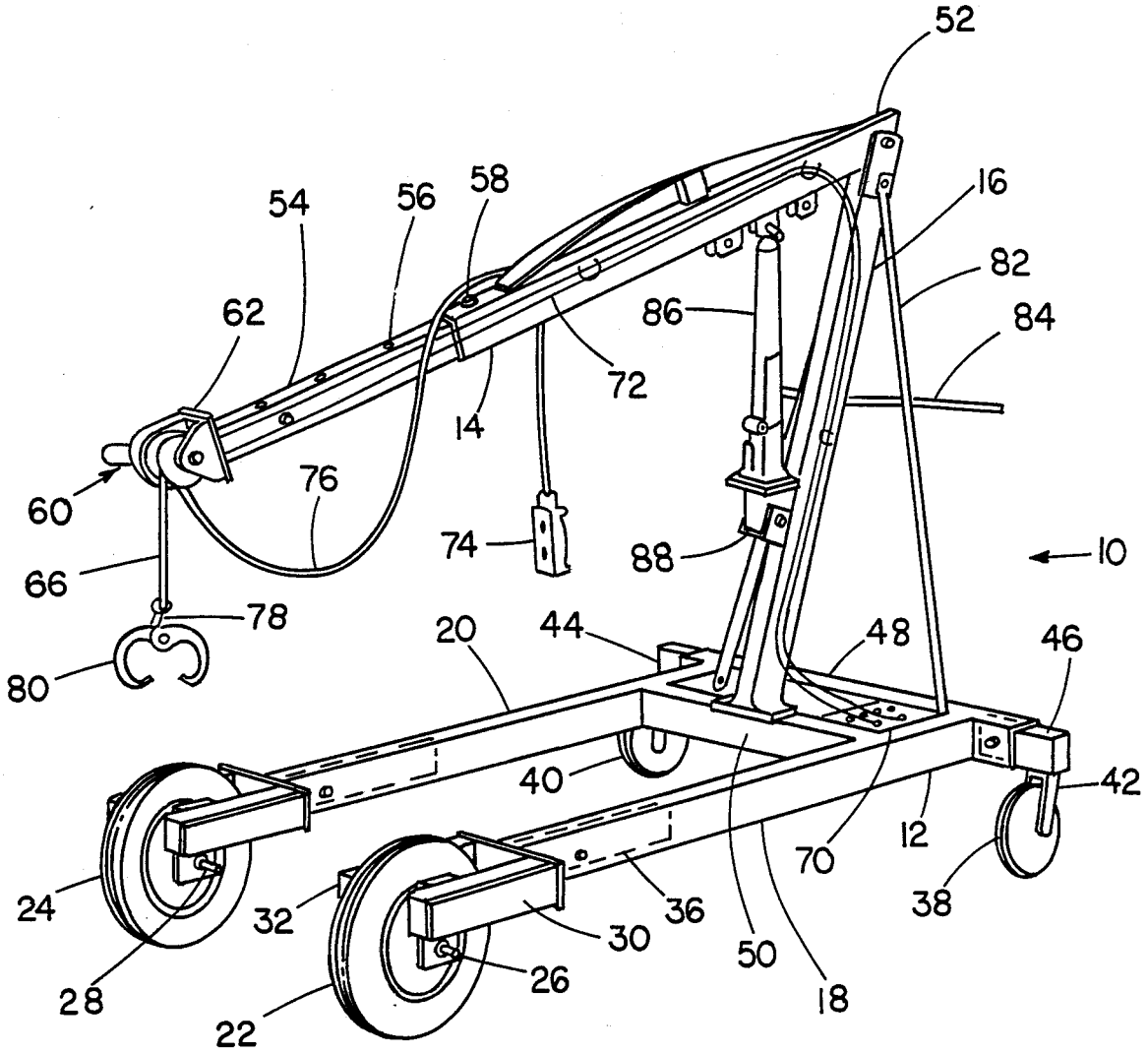
FIG. 1 is a pictorial view of the apparatus of the subject invention.
Figure 4:
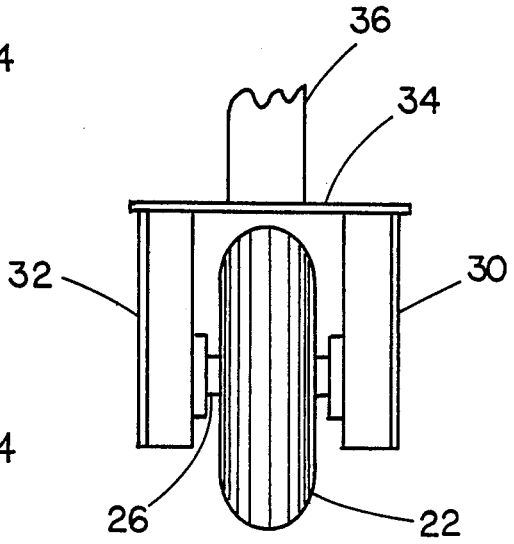
FIG. 4 is a front, somewhat elevated, view of a portion of the apparatus of FIG. 1 showing one of the large fixed wheels.

Referring now more particularly to FIG. 1, there is provided lifting and positioning apparatus 10 having frame 12 for supporting extendable arm 14 which is attached to frame 12 by means of upwardly extending beam 16. Frame 12 includes a pair of beams 18 and 20 which preferably are parallel. Large wheels 22 and 24 are connected to one end of beams 18 and 20 respectively. The large wheels are mounted on axles 26 and 28 which are adapted to remain in a fixed position that is not to swivel, therefore the wheels 22 and 24 roll in a substantially straight line only. This may be seen better in reference to FIG. 4 which shows wheel 22 mounted on axle 26 with the axle being further connected to fixed brackets 30 and 32. Fixed brackets 30 and 32 are connected to plate 34 which in turn is connected to telescoping rod 36 which is received inside of beam 18 as shown in FIG. 1. Wheel 24 is attached to beam 20 in a substantially identical manner as wheel 22.

Referring again to FIG. 1, smaller swivelable wheels 38 and 40 are connected to swivel brackets 42 and 44 respectively so that the small wheels may rotate to 360 degrees. Each small wheel is connected to a sliding rod 46 which is received within beam 48. Beam 48 is connected to parallel beams 18 and 20. Beam 50 also connects beam 18 to beam 20 and, together with beam 48, forms part of the frame 12. Upwardly extending beam 16 is connected to beam 50. Upwardly extending beam 16 extends toward one end of the apparatus to counterbalance the weight which will be on the other end of the apparatus which will be explained below.

Extension arm 14 includes beam 52 which is pivotably connected to beam 16 and includes telescoping rod 54, portions of which are received inside of beam 52.

Telescoping rod 54 includes a plurality of holes 56 which, together with bolt 58 holds the telescoping rod in place with respect to beam 52. The extension length of arm 14 is thereby made adjustable.

Figure 3:
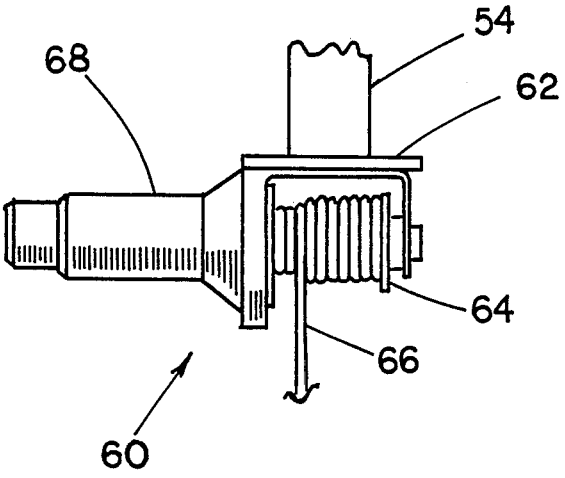
FIG. 3 is a front view of a portion of the apparatus of FIG. 1 showing the winch.

Winch 60 is attached to the end of telescoping rod 54 through plate 62 which may be better seen in reference to FIG. 3. Winch 60 includes reel; 64 which receives a length of steel cable or rope 66. Electric drive motor 68 is connected to one side of reel 64 for raising and lowering rope 66.

Referring again to FIG. 1, winch motor 68 is connected to battery 70 by cable 72. The battery is mounted on frame 12 through cables 72. The upward and downward motion of winch 60 is controlled by control box 74 which is connected to the winch by cables 76. Hook 78 is connected to one end of rope 66. Grasping mechanism 80 is secured to rope 66 by hook 78.

A pair of rods 82 are mounted between upwardly extending beams 16 and parallel beams 18 and 20 respectively. A handle 84 is connected to the rods 82. The handle 84 is used by the operator of the apparatus to properly position the apparatus whereby the grasping means 80 may be placed directly over the construction material such as the log to be picked up so that the operator may lower the grasping means onto the log by means of control box 74.

Hydraulic cylinder 86 is connected between upwardly extending beam 16 and arm 52 for applying leverage to arm 52 for moving the arm upwardly and downwardly. A rod (not shown) is adapted to be received in slot 88 of the hydraulic cylinder for manually providing upward and downward motion to the air cylinder. The hydraulic cylinder 86 provides a mechanical work for lifting the construction material while the winch provides a mechanism for raising and lowering rop 66 for positioning grasping means onto the log and also for lifting and lowering lighter objects.

Figure 2:
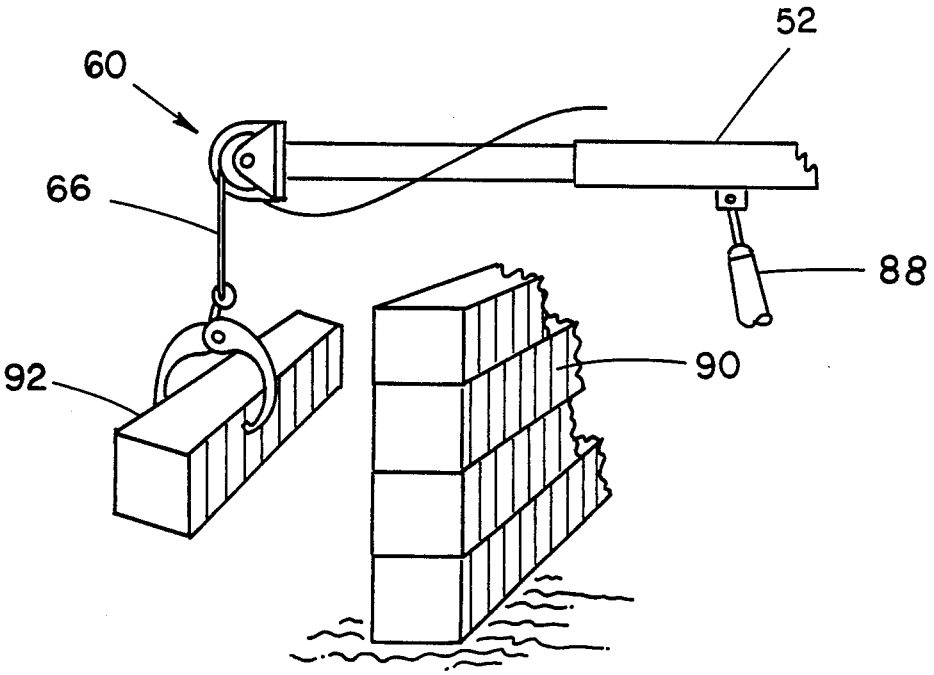
FIG. 2 is a partial pictorial view showing a portion of the apparatus of the subject invention lifting and positioning construction material.

As previously stated the apparatus 10 is particularly useful in the construction industry in particularly for lifting and positioning logs for building log homes. As can be seen from FIG. 2, extension arm 52 is placed over partially completed log wall 90. Rope 66 has been lowered from winch 60 and the grasping mechanism 80 has gripped log 92. Lifting arm 52 is in the process of raising log 92 to a position on top of wall 90 by the actuation of hydrolic cylinder 88. The positioning of log 92 may be readily completed simply by the operator moving the apparatus by pushing or pulling on handle 84. The moving of the apparatus is made easier because the wheels which are near the handle swivel while the wheels which are directly under the loads, namely wheels 22 and 24 do not swivel and are larger than wheels used in prior art devices.

Furthermore, since the winch 60 is used the grasping mechanism may be mechanically dropped by the operator onto log 92 simply by using winch 60 rather than by hand as was done in the past. Thus, a single person using apparatus 10, may lift and position logs weighing hundreds of pounds in the construction of a log home where in the past two and sometimes three persons were needed to do the same job.

From the foregoing description of the illustrative embodiment of this invention, it would be apparent that many modifications may be made therein. It will be understood therefore that this embodiment of the invention is intended as an exemplification of the invention only and that the invention is not limited thereto. It is to be understood that it is intended that the appended claims cover all such modifications that will fall within the true spirit and scope of the invention.

I claim:

1. Apparatus for lifting and positioning construction material comprising:

a frame including a pair of substantially parallel beams; first and second wheels connected to said parallel beams at one end of said frame;

at least a third wheel connected to the other end of said frame; said first and second wheels being substantially larger in diameter than said third wheel;

a third beam connecting said pair of beams together;

a fourth beam extending upwardly from said frame;

a fifth beam swivelly connected to said fourth beam; said fifth beam projecting over said first and second wheels;

a winch connected to the end of said fifth beam which is not attached to said fourth beam; said winch including a motor and a rope; an expandable and contractible grasping means connected to said rope for holding the construction material.

2. An apparatus as set forth in claim 1 wherein said first and second wheels are adapted to roll in a straight line only.

3. An apparatus as set forth in claim 1 further including a fourth wheel on the other end of said frame, said third and fourth wheels each mounted on a swivel.

4. An apparatus as set forth in claim 1 further including a handle connected near said other end of said frame to enable said apparatus to be readily maneuvered.

5. An apparatus as set forth in claim 1 wherein said motor being an electric motor; control means connected to said winch for winding and unwinding said rope.

6. An apparatus as set forth in claim 5 further including a battery resting on said frame and being connected to said motor.

7. An apparatus as set forth in claim 2 wherein said first and second wheels each are connected to rods which are adapted to telescope from said pair of parallel beams.

8. An apparatus as set forth in claim 3 wherein said third and fourth wheels are connected to rods which are adapted to telescope from said frame.

9. An apparatus as set forth in claim 1 wherein said winch is connected to a rod which adapted to telescope from said fifth beam.

10. An apparatus as set forth in claim 1 further including leverage means connected between said fourth and fifth beams for raising and lowering said fith beam.

11. An apparatus as set forth in claim 10 wherein said leverage means is a hydrolic cylinder.

12. An apparatus as set forth in claim 1 wherein said winch is readily removable from said fifth beam.

13. An apparatus for lifting and positioning construction material comprising:

a frame including a pair of substantially parallel beams;

first and second wheels connected to said parallel beams at one end of said frame;

said first and second wheels adapted to roll in a substantially straight line only;

at least a third wheel connected to the other end of said frame;

said first and second wheels being substantially larger in diameter than said third wheel;

a third beam connecting said pair of beams together;

a fourth beam extending upwardly from said frame;

a fifth beam swivelly connected to said fourth beam; the fifth beam projecting over said first and second wheels;

a winch connected to the end of said fifth beam which is not attached to said fourth beam; said winch including a rope; said winch further including electric motor; control means connected to said winch for winding and unwinding said rope; an expandable and contractible grasping means connected to said rope for holding the construction material.

14. An apparatus as set forth in claim 13 further including a fourth wheel on said other end of said frame; said third and fourth wheels each mounted on a swivel.

15. An apparatus as set forth in claim 13 further including a handle connected near said other end of said frame to enable the apparatus to be readily maneuvered.

16. An apparatus as set forth in claim 13 further including a battery mounted on said frame and connected to said motor.

17. An apparatus as set forth in claim 13 wherein said first and second wheels each are connected to rods which are adapted to telescope from said pair of beams.

18. An apparatus as set forth in claim 13 wherein said third and fourth wheels are connected to rods which telescope from said frame.

19. An apparatus as set forth in claim 13 wherein said winch is connected to a rod which is adapted to telescope from said fifth beam.

* * * * *